US006004166A

United States Patent [19]

Cardas

[11] Patent Number: 6,004,166

[45] Date of Patent: Dec. 21, 1999

[54] ELECTRICAL CONNECTOR FOR PLURAL CIRCUITS

[76] Inventor: George F. Cardas, 480 11th St., SE., Bandon, Oreg. 97411

[21] Appl. No.: 08/939,766

[22] Filed: Sep. 29, 1997

[51] Int. Cl.[6] ..... H01R 4/30

[52] U.S. Cl. ..... 439/801; 439/781

[58] Field of Search ..... 439/781, 782, 439/573, 92, 97, 801, 791, 794, 374, 459, 412, 551

[56] References Cited

U.S. PATENT DOCUMENTS 3,519,980 7/1970 Mosley ..... 439/459
4,188,085 2/1980 Aldridge et al. ..... 439/801
4,643,512 2/1987 Prodel ..... 439/412
4,764,127 8/1988 Price ..... 439/551

*Primary Examiner*—Paula Bradley
*Assistant Examiner*—Alexander Gilman
*Attorney, Agent, or Firm*—Boniard I. Brown

[57] ABSTRACT

An electrical connector has separable members for clamping plural conduits for separable circuits for electronic equipment. The members are clamped by a securement member extending through passages in the members and secured by a fastener. A plurality of prongs extend through openings in the members to engage electrical conductors to external circuits.

19 Claims, 2 Drawing Sheets

ELECTRICAL CONNECTOR FOR PLURAL CIRCUITS

BACKGROUND AND SUMMARY OF THE INVENTION

The present invention relates generally to electrical connectors, and more particularly to connectors having body components which clamp a plurality of conduits for a plurality of circuits of electronic equipment. A simplified arrangement provides for clamping two or more conduits by operation of a single member or knob.

Connection assemblies for two or more circuits have heretofore generally involved separate mounting assemblies for each circuit. As shown in FIGS. 1–3, a typical prior art arrangement for the connection of two circuits involves a pair of nuts or knobs A, a threaded elongated member B for each circuit, with fitting components C having openings for the elongated members, recesses to receive flanges thereof, a mounting member D, and separate nut elements for securing components together for each circuit.

According to the present invention, an electrical connector comprises a base member having a central passage and a plurality of spaced openings, a bridge member having a central passage and a plurality of spaced openings, the passages and openings being registrable respectively with the base member passage and openings, a securement member, typically threaded, having a head portion and an opposite end portion and being extensible through the passages in the base and bridge members, a plurality of conventional prongs extend through the openings in the base member and into the openings in the bridge member, and are adapted for electrical connection to external circuitry. The base member and bridge member are adapted to receive electrical connectors therebetween. Manually operable knob means engages the end portion of the securement member and is operable to urge together the bridge member and the base member to the clamp electrical connectors therebetween.

DESCRIPTION OF THE PREFERRED EMBODIMENTS

Figure 1:
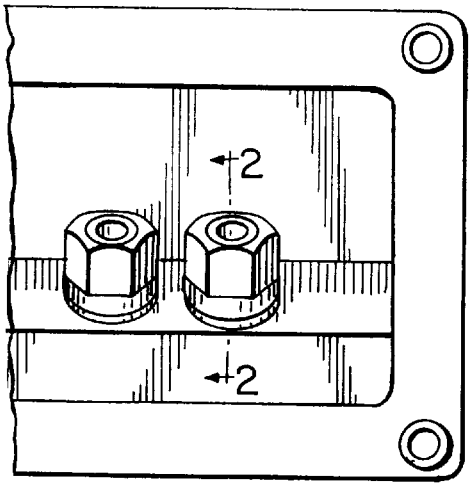
FIG.—1 (PRIOR ART)
FIGS. 1, 2 and 3 illustrate a typical prior art arrangement wherein separate circuits require separate connection assemblies.
Figure 2:
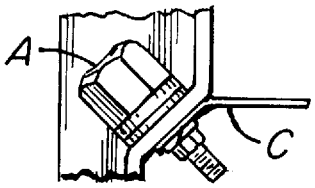
FIG.—2 (PRIOR ART)
Figure 3:
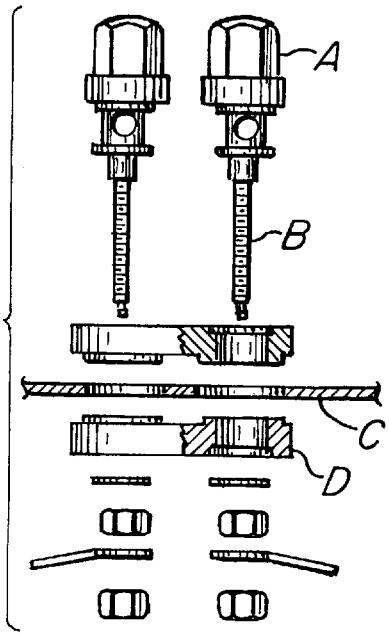
FIG.—3 (PRIOR ART)
Figure 4:
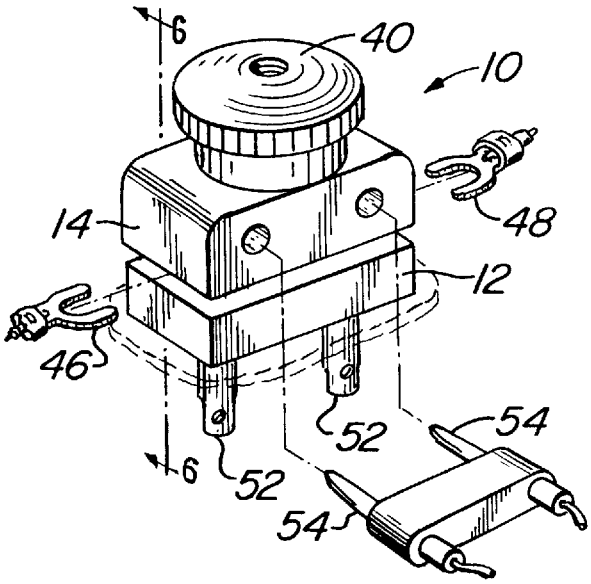
FIG. 4 is a perspective view of an electrical connector according to the present invention in association with a conventional electrical plug.
Figure 5:
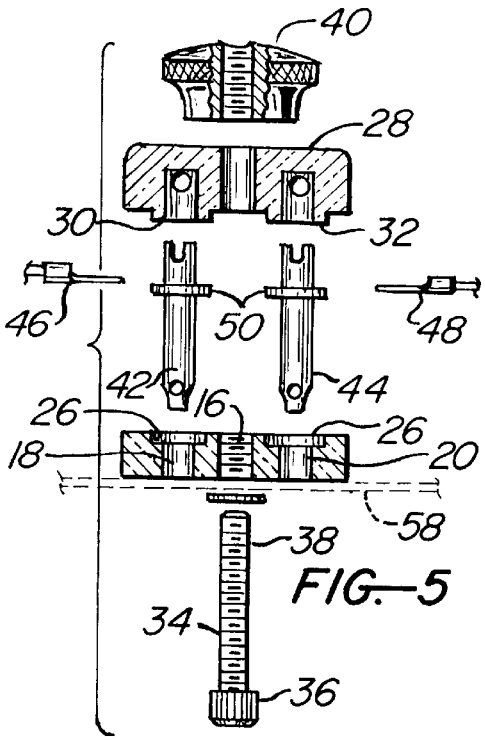
FIG. 5 is an exploded sectional view of the components of the embodiment of FIG. 4.

Referring to the drawings, an electrical connector 10 according to the invention comprises a base member 12 and a bridge member 14. The base member has a central threaded passage 16 and two openings 18, 20 defined therethrough, each opening having an annular recess 26 defined about its upper portion (FIG. 5).

The bridge member defines a central passage 28 and two openings 30, 32 which terminate within the bridge member and are registrable with the corresponding openings in the base member.

Figure 6:
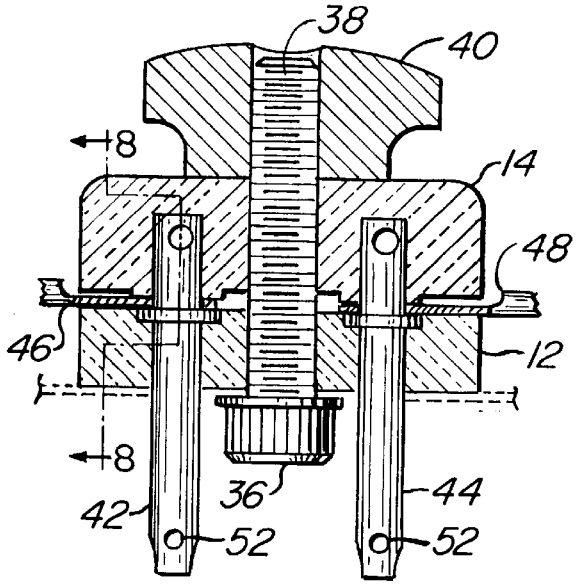
FIG. 6 is a sectional view taken at line 6—6 in FIG. 4.

A securement member or threaded fastener 34 is adapted to extend through the central passages of the base and bridge members, and has a head portion 36 adapted to seat against the lower surface of the base member, and a threaded end portion 38 adapted to extend above the assembled head and bridge members (FIG. 6).

A knob 40 is threadedly engageable with end portion 38 of the threaded fastener, the head portion 36 of which seats against the base member with its threaded end portion extending above the assembled head and bridge members.

In the assembled connector, conventional prongs 42, 44 extend through the openings of the base member and into the openings 30, 32 of the bridge member.

Electrical conduit end portions 46, 48 are disposed between the head and bridge members (FIG. 6) and engage annular flanges or shoulders 50 of the prongs (FIG. 6).

The prongs have openings 52 to receive electrical conductors which interconnect with external circuitry and apparatus. These electrical conductors may typically be conventional dual or double banana plugs 54.

With the prongs in place and the electrical conduits 46, 48 positioned between the body and bridge members, knob 40 is rotated to clamp the base and bridge members together, thus to connect the electrical connectors therebetween and in engagement with the prong shoulders 50.

In installing the connector assembly on a chassis, typically a chassis for high-fidelity equipment, the threaded fastener 34 is inserted through the registering passage in the base and bridge members with the head portion 36 of the fastener engaging a chassis wall 58 between the lower surface of the base member and the fastener head portion 36. The knob 40 is rotated to clamp together the base and bridge members between the knob 40 and the head portion 36 of the threaded fastener.

Figure 8:
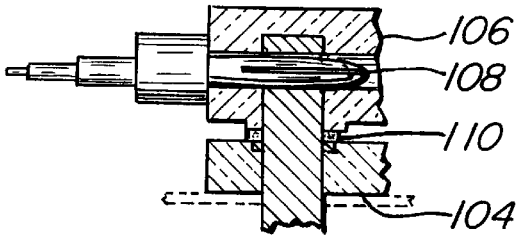
FIG. 8 is a fragmentary sectional view taken at line 8—8 in FIG. 7, showing engagement of a conduit end portion in an opening of a conventional prong.
Figure 7:
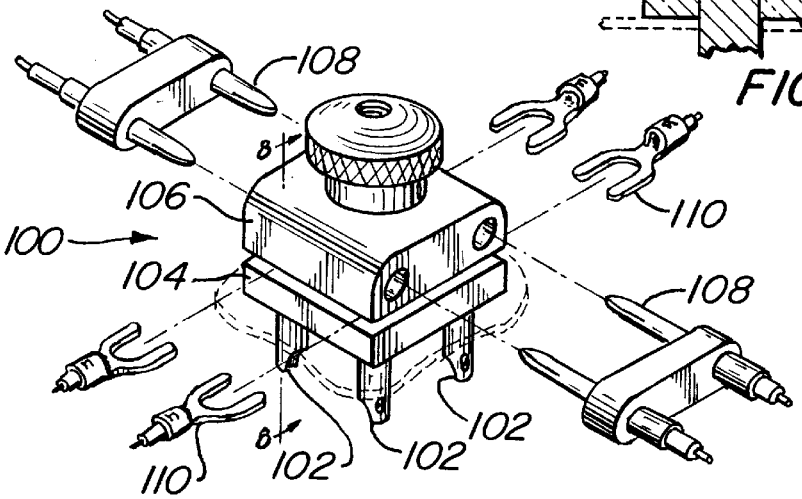
FIG. 7 is a perspective view of an embodiment of the present invention for connection of four electrical circuits.

FIG. 7 illustrates an embodiment 100 of the invention wherein four prongs 102 are received in openings (not shown) in a base member 104 and extend into openings in the upper portion of the bridge member 106. Openings (not shown) in the bridge member 106 receive members 108 of conventional banana-type conductors for connection with external circuitry. Four end portions 110 of electrical conduits are engaged with the prongs and are clamped between the bridge member 106 and base member 104, as indicated in FIG. 8. Operation and assembly are otherwise generally similar to those of the earlier described embodiment.

Electrical connectors of high quality and relatively low cost are provided. The components may typically and preferably be molded, typically of fiberglass-reinforced plastic. Substantial time and expense in assembly of components is involved in the assembling and mounting of electrical connectors for two or more circuits.

Thus there has been shown and described a novel electrical connector for plural circuits which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. An electrical connector comprising:

a base member having therethrough a longitudinal passage and a plurality of spaced openings, a bridge member having defined therethrough a longitudinal passage and having a plurality of spaced openings therein, said passages and openings being registrable respectively with said base member passage and said openings, a securement member having a head portion and an opposite end portion, said securement member being extensible in said passages in the base and bridge members, a plurality of prongs extendable through said openings in the base member and into said openings in the bridge member, said prongs being adapted for electrical connection to external circuitry, said base member and bridge member being adapted to receive electrical connectors inserted transversely of said spaced openings therebetween, and a knob engageable with said end portion of the securement member and operable to urge together the bridge member and the base member to clamp the electrical connectors therebetween.

2. An electrical connector according to claim 1, wherein:

the prongs have annular shoulders spaced from their upper ends, and the base member defines an annular recess about the upper end of each of said openings therein to receive said annular shoulders of the prongs, said electrical connector engaging said annular shoulders of the prongs for electrical connection with external circuitry.

3. An electrical connector according to claim 1, wherein:

a wall of a chassis is clamped between said securement member head portion and a lower surface of the base member.

4. An electrical connector according to claim 1, wherein:

at least three said openings extend through the base member and at least three said openings are provided in the bridge member, said openings in the base and bridge members receiving a plurality of said prongs, and said prongs have openings therein to receive a plurality of conductors for engagement with external circuitry.

5. An electrical connector according to claim 1, wherein:

the base member and the bridge member are clamped together between said knob and the securement member head portion.

6. An electrical connector according to claim 5, wherein:

the knob engages an upper surface of the bridge member, and the securement member head portion engages a lower surface of the base member.

7. An electrical connector according to claim 1, wherein:

said prongs have openings therein to receive conductors for electrical connection to external circuitry.

8. An electrical conductor according to claim 7, wherein:

said prongs have openings in their upper portions to receive said conductors.

9. An electrical conductor according to claim 7, wherein:

said prongs have openings in their lower portions to receive said conductors.

10. An electrical connector according to claim 7, wherein:

said conductors are plug portions of banana-type conductors.

11. An electrical connector comprising:

a base member having therethrough a first longitudinal passage and at least two spaced openings, a bridge member having a second longitudinal passage therethrough and having at least two spaced openings therein, said first and second passages being registrable and said spaced openings in the base member being registrable with said spaced openings in the bridge member, a securement member extensible in said first and second passages and adapted to secure together the base member and the bridge member, a knob threadedly engageable with said securement member and operable to urge together the bridge member and the base member to clamp said electrical connectors, a plurality of prongs adapted for extension through said spaced openings in the base member and into said spaced openings in the bridge member, said prongs being adapted for engagement for connection with external circuitry, and said base member and bridge member being adapted to receive external electrical connectors therebetween to engage said prongs, said electrical connectors having end portions adapted to engage the prongs.

12. An electrical connector according to claim 11, wherein:

the base member and the bridge member are clamped together between said knob and a securement member head portion.

13. An electrical connector according to claim 11, wherein:

the knob engages an upper surface of the bridge member, and the securement member head portion engages a lower surface of the base member.

14. An electrical connector according to claim 11, wherein:

said electrical connectors have end portions adapted to extend about the prongs.

15. An electrical connector according to claim 11, wherein:

at least three said openings extend through the base member and at least three said openings are provided in the bridge member, said openings in the base and bridge members receive a plurality of said prongs, and said prongs have openings therein to receive a plurality of conductors for engagement with external circuitry.

16. An electrical connector comprising:

a base member having therethrough a first longitudinal passage and at least two spaced openings, a bridge member having a second longitudinal passage therethrough and having at least two spaced openings therein, said first and second passages being registrable and said spaced openings in the base member being registrable with said spaced openings in the bridge member, a securement member extensible in said first and second passages and adapted to secure together the base member and the bridge member, a plurality of prongs adapted for extension through said spaced openings in the base member and into said spaced openings in the bridge member, said prongs having annular shoulders spaced from their upper ends, and being adapted for engagement for connection with external circuitry, and said base member and bridge member being adapted to receive external electrical connectors therebetween to engage said prongs, said electrical connectors having end portions adapted to engage the prongs, the base member defining an annular recess about the upper end of each of said openings therein to receive said annular shoulders of the prongs, said electrical connectors engaging said annular shoulders of the prongs for electrical connection with external circuitry.

17. An electrical connector according to claim 16, wherein:

said electrical connectors have end portions adapted to extend about the prongs.

18. An electrical connector according to claim 16, wherein:

said prongs have openings therein to receive conductors for electrical connection to external circuitry.

19. An electrical connector according to claim 16, wherein:

said conductors are plug portions of banana-type conductors.

* * * * *